US005460347A

United States Patent [19]

Schacher

[11] Patent Number: 5,460,347

[45] Date of Patent: Oct. 24, 1995

[54] TETHERING DEVICE

[76] Inventor: Andrew I. Schacher, 19-4A Max Dr., Morristown, N.J. 07960

[21] Appl. No.: 138,763

[22] Filed: Oct. 19, 1993

[51] Int. Cl.[6] ..... A47G 1/10

[52] U.S. Cl. ..... 248/316.5; 211/13; 248/309.1

[58] Field of Search ..... 248/309.1, 316.5, 248/316.1, 316.7, 918, 505, 205.2, 104; 24/300, 301, 172, 200; 211/13

[56] References Cited

U.S. PATENT DOCUMENTS

| | | | |
|---|---|---|---|
| 276,567 | 4/1883 | Dobler | 24/200 |
| 1,385,085 | 7/1921 | Mahoney | 248/104 |
| 1,496,601 | 6/1924 | Reinhart | 24/300 |
| 2,698,598 | 1/1955 | Hodley | 248/104 |
| 2,994,300 | 8/1961 | Grahling | 24/300 X |
| 3,439,387 | 4/1969 | Churcher | 24/300 |
| 3,727,272 | 4/1993 | Rhoder | 24/300 |
| 4,765,037 | 8/1988 | Perry | 24/301 |
| 4,989,811 | 2/1991 | Miller et al. | 248/205.2 |
| 5,104,076 | 4/1992 | Goodall, Jr. | 248/205.2 |
| 5,130,899 | 7/1992 | Larkin et al. | 248/300 X |
| 5,135,189 | 8/1992 | Ghazizadeh | 248/160 X |
| 5,195,634 | 3/1993 | Zang | 248/309.1 X |

*Primary Examiner*—Ramon O. Ramirez
*Assistant Examiner*—Korie H. Chan
*Attorney, Agent, or Firm*—Klauber & Jackson

[57] ABSTRACT

A tethering device for remote control units for televisions, VCR's, stereo systems and the like. The tethering device is made of an elasticized tethering cord having a universal attachment element at one end for attachment to a fixed item of furniture and an infinitely adjustable holding element capable of retainingly holding a remote control unit, without interfering with functional use of the remote control. The cord is relatively short, such that it is not likely to become entangled with itself or other objects or allow the remote control unit to hit the ground but sufficient to permit the retainingly held remote control to be moved and held in operative position without detachment from the tethering device.

8 Claims, 2 Drawing Sheets

FIGURE 1
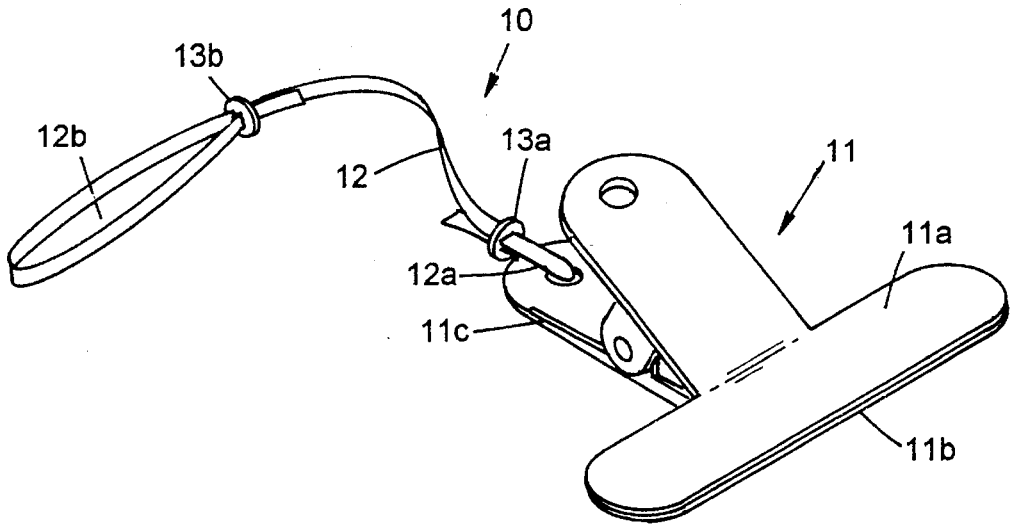
FIGURE 2
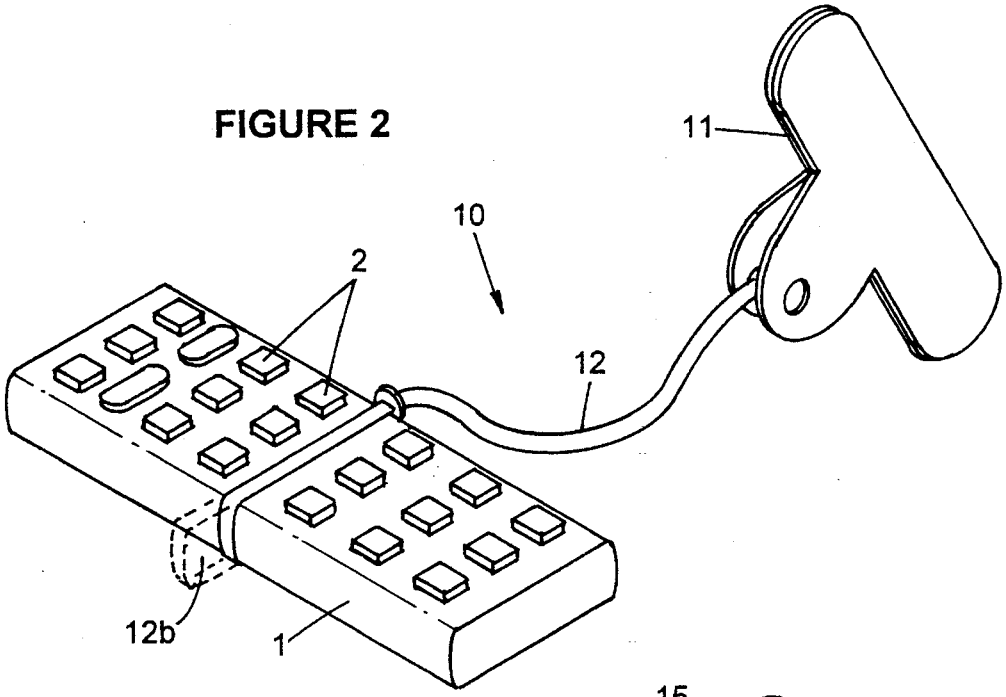
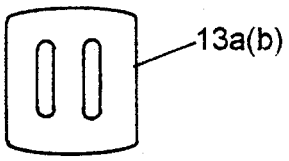
FIGURE 2a
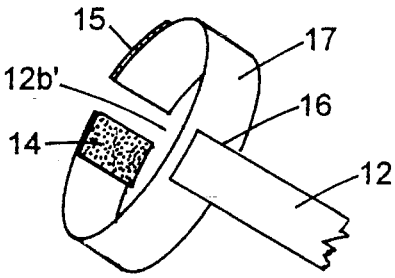
FIGURE 2b

TETHERING DEVICE

FIELD OF THE INVENTION

This invention relates to devices used in holding objects to keep them from being misplaced, and particularly to devices for automatically retaining remote control devices in readily utilizable locations.

BACKGROUND OF THE INVENTION

With the proliferation of electronic devices (e.g., televisions, VCR's stereo equipment) using non-connected, small, stand-alone, remote control units, particularly of the infrared control type, there has been an increased tendency for such units to be frustratingly misplaced. The remote control units are usually put down by a user, immediately after use, without conscious thought regarding where the unit is placed. However, because of the relatively small size and slippery shape (usually, of a thin, rectangular, smooth plastic, adapted for ease in hand holding and finger operation) of remote control units, they tend to slip between sofa and chair cushions, become hidden by magazines, and otherwise become misplaced from subsequent use, when required. In order to prevent the misplacing of remote control units several common expedients have been suggested and utilized.

In many hotels and motor lodges, having remote control televisions, the remote control units are fixed into a holder, non-removably attached to an item of furniture, in particular, a night table. At most, the remote control unit is permitted only a limited swivelling action. While effective, in preventing misplacing of the remote control units, this expedient requires mutilation of furniture and direct proximity of the user with the night table for operation thereof.

Devices, as described in U.S. Pat. Nos. 4,852,746 and 4,893,222, are specific holders for remote control units, the former provides a fixed position storage device for the remote control unit and the latter discloses an illuminated movable holder. With such devices, actual use of the remote control unit requires complete removal of the unit from a fixed position or fixed position device, such as from the fixed position holder described in the former patent. The holder disclosed in the latter patent merely makes the remote unit more bulky but does not otherwise prevent its being misplaced together with the holder. With both type of holders there must be a conscious effort on the part of the user to return the remote control to a known location. This effort is often absent.

SUMMARY OF THE INVENTION

The present invention comprises a tethering device for a stand-alone, hand held remote control unit having controls thereon for operation of an electronic device. The tethering device comprises adjustable attachment means capable of being removably attached to a plurality of objects, such as furniture, furnishings and the like, in operative proximity to the electronic device. The tethering device further comprises elastic adjustable holding means capable of holding remote control units of varying dimensions with a non-slip grip but without impeding use of the controls thereon.

The adjustable attachment means and elastic adjustable holding means are connected by connection means. Remote control units held by the tethering device are thus normally in a position accessible to a user. The connecting means is adapted to permit movement of the remote control unit, by a user's hand, from the accessible position, into operative association with the electronic device. The connection means should however, not be excessively long, in order to avoid entanglement and, more importantly, not permit the relatively fragile remote control units from falling to the floor and possibly breaking, when the operative association is completed.

It is an object of the present invention to provide an economical means for continuously holding remote control units of varying dimensions, with a positive non-slip grip, in a known accessible position, at all times, even during use thereof.

It is a further object of the present invention to provide such means whereby return to an accessible position requires neither conscious effort nor thought by the user.

It is a still further object of the present invention to provide such means wherein it is adaptable for use with substantially all types of remote control units and for holding the remote control in many locations in a room, containing the device to be controlled thereby.

These and other objects, features and advantages of the present invention will become more evident form the following discussion and the drawings in which:

BRIEF DESCRIPTION OF THE DRAWINGS

FIG. 1 is an isometric view of the tethering device of the present invention;

FIG. 2 is a view of the tethering device of FIG. 1 being adjustably fitted to a remote control unit;

FIG. 2*a* is a view of a tightening ring used to effect an infinitely adjustable holding of the remote control unit;

FIG. 2*b* depicts an alternative hook and eye type adjustable fitting means;

DETAILED DESCRIPTION OF THE INVENTION

Figure 3:
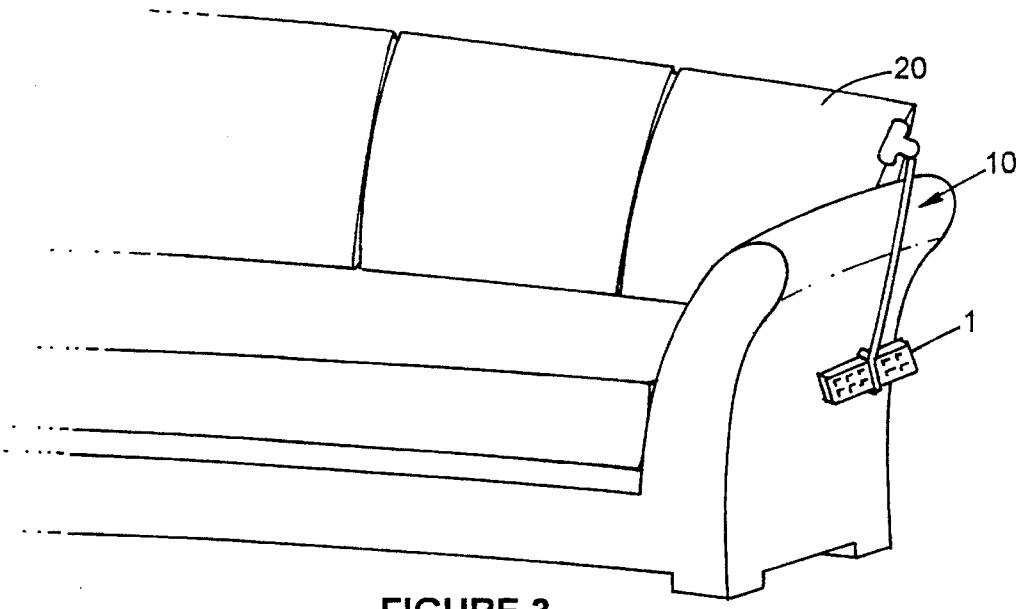
FIG. 3 depicts the tethered remote control unit attached to an item of furnishing for ready accessibility.

Generally the present invention comprises a tethering control device for remote control units, wherein said device comprises substantially universal attachment means for removably attaching the tethering control means to a fixed item of furniture or furnishing in a room or other area where the device, to be operated by the remote control unit, is located and in proximity to a position where a user desires to be situated. Prior art tethering devices for various objects have usually been specifically adapted for attachment to beds for retained use by invalids or infants, e.g., wall cord attached hospital bed bells (U.S. Pat. No. 2,876,464); corded switches for operation, from a hospital bed, of nurse-calls, radio, television, and the like (U.S. Pat. No. 3,179,991); handkerchief holders (U.S. Pat. No. 2,068,560); and infant bottle holders (U.S. Pat. No. 580,837). Such devices cannot however be removed from specific positions and proximity to wall cords, bed hardware or furnishings or be used with self standing remote control units. In addition, they are not amenable to attachment to chairs, sofas or loungers, from which many remote control units are operated.

The device of the present invention further comprises infinitely adjustable elastic strap holding means whereby substantially any remote control unit can be held tightly thereby in a manner which does not interfere with use thereof. In this regard it is noted that remote control units are not amenable to normal holding means since they are generally smooth, hard, and rectangular in configuration to provide comfort in operation, and there are accordingly no protrusions for effecting a holding connection. Clamps and other holding means of this type would: impede holding of the remote control unit; impede operation thereof by blocking operation controls; or be limited in operative scope to only a few size remote control units.

The adjustable strap holding means of the present invention is accordingly of minimal thickness and width whereby it impedes neither holding nor operation of the remote control unit. The adjustable strap holding means and the universal attachment means are connected with a tethering element such as an elastic cord which is of a short length (generally not more than about 1–2 feet—0.3 to 0.6 m) whereby it is not subject to entanglement, is readily reachable, and does not permit a remote control unit, held thereby, to contact the ground. The tethering element should however, provide an extended length sufficient for a user to comfortably bring the remote control unit, held thereby, into appropriate aiming position, relative to the device being controlled (i.e. at least about one foot of extension). The cord should be of a length whereby stretching or extension of the cord, for operative association with the device, to be operated by the remote control unit, is with minimal resistance and certainly not with sufficient force to pull off the universal attachment means or cause a dragging of a non-anchored furnishing, such as a pillow.

It is preferred that the universal attachment means comprises a relatively large, non-marring (e.g. with felt or soft plastic lining the holding jaws) spring clip with an open throat capable of being attached to furnishings such as pillows, chair arms, bed frames, table edges and the like. The clip action permits initial rapid positioning as well as repositioning of the tethering device wherever and whenever required.

The adjustable strap holding means is preferably comprised of a strap segment which is no more than about ¼ to ½" in width and no more than ⅛–¼" in total thickness, whereby it can be readily positioned between rows of buttons on remote control units, without impeding the operation thereof. The length of the strap segment is sufficient to provide a loop of at least four inches to about ten inches, in order to accommodate the dimensions of most hand held remote control units. In addition, the adjustable strap holding means should have a degree of elasticity whereby it can be stretched slightly, when being placed around the remote control unit, and locked in such stretched condition around the remote control unit, to ensure a positive, non-slip grip of the generally smooth plastic remote control unit. Such non-slip grip is important in order to prevent the relatively fragile remote control units from inadvertantly being loosened and falling to the ground and breaking. In addition, the locking should be able to resist normal tugging, occurring with utilization of the remote control unit. It is preferred, from an economical and manufacturable standpoint, that the tethering cord and the adjustable strap holding means be integrally formed (i.e. the strap holding means is an end of the tethering cord, which has a flat, strap-like configuration along its entire length). In this regard, it is preferred that the end of an elasticized tethering strap be combined with a Velcro® type of hook and eye, fabric locking, whereby a variable size holding loop can be made, to securely hold any remote control unit. The hook and eye material is arranged to provide a loop which accommodates remote control units having a four inch width by a one inch thickness (the maximum comfortable size dimensions of most hand held remote control units). Alternatively, an end of the tethering strap is formed into the requisite adjustable strap and locked in place with a small strap ring tightener or other similar tighteners.

DETAILED DESCRIPTION OF THE DRAWINGS AND THE PREFERRED EMBODIMENT

With specific reference to the drawings, in FIG. 1, the tethering device 10 of the present invention is shown with spring clip 11 having movable jaws 11*a* and 11*b* for effecting a substantially universal type of holding to various items of furniture or furnishings, as exemplified in FIG. 3. To prevent any marring or damage to surfaces to which the clip 11 is engaged, the jaws 11*a* and 11*b* of the clip are relatively wide, to spread the load, preferably about four inches. In addition, the spring (not shown) of the clip is not overly tensioned and the engaging portions of the movable jaws 11*a* and 11*b* are lined with a cushioning material such as felt or soft plastic. This is particularly advantageous if the clip is to be used with hard surface furniture, which would be marred thereby, instead of yielding fabric surface furnishings such as pillows.

An end of elastic strap 12 is attached to a handle 11*c* of clip 11, by a simple through-loop 12*a* held in place by plastic tightening ring 13*a*. Release of through-loop 12*a* permits replacement of the clip 11 with other, more object-specific attachment means, if desired. The other end of elastic strap 12 is formed into a second loop 12*b* held by tightening ring 13*b*. The second loop 12*b*, of elastic strap 12, provides the adjustable strap means for snugged holding, of remote control units of varying sizes and widths, with adjustment of tightening ring 13*b*. The tightening rings 13*a* and 13*b* are substantially identical and comprise flat plastic rings such as shown in FIG. 2*a*.

The engaging end of elastic strap 12, which forms loop 12*b*, is relatively narrow whereby it can be placed around a remote control unit 1, without interfering with control buttons 2 thereon, as shown in FIG. 2. Elastic strap 12 is also relatively short, between the respective loops 12*a* and 12*b*, such that it will not readily loop back upon itself and become entangled with itself or other items, does not reach the floor, and is readily accessible at all times, such as shown in FIG. 3, with attachment of the tethering device 10 to a sofa pillow 20. Except for low couches, most seats are about 18" off the ground and the elastic strap 12 is accordingly dimensioned to prevent remote control units 1 from reaching the ground, even with an elasticized drop (i.e. "bungee cord" type).

FIG. 2*b* depicts an alternative embodiment for attaching the elastic strap 12 to the remote control unit 1. The ends of the elastic strap 12 are attached, at site 16, to a fabric strip 17 with opposing surface areas of hooks and eyes 14 and 15. Hooks and eye areas 14 and 15 are attachable to form loop 12*b*' and are dimensioned appropriately to provide such loop, generally of substantially flattened width of from about two to four inches and a thickness of up to about one inch (a loop with a maximum circumference of about 10 inches). A loop of such dimensions, related to the holding capability of the human hand, is sufficient for holding nearly every hand held remote control device.

Figure 4:
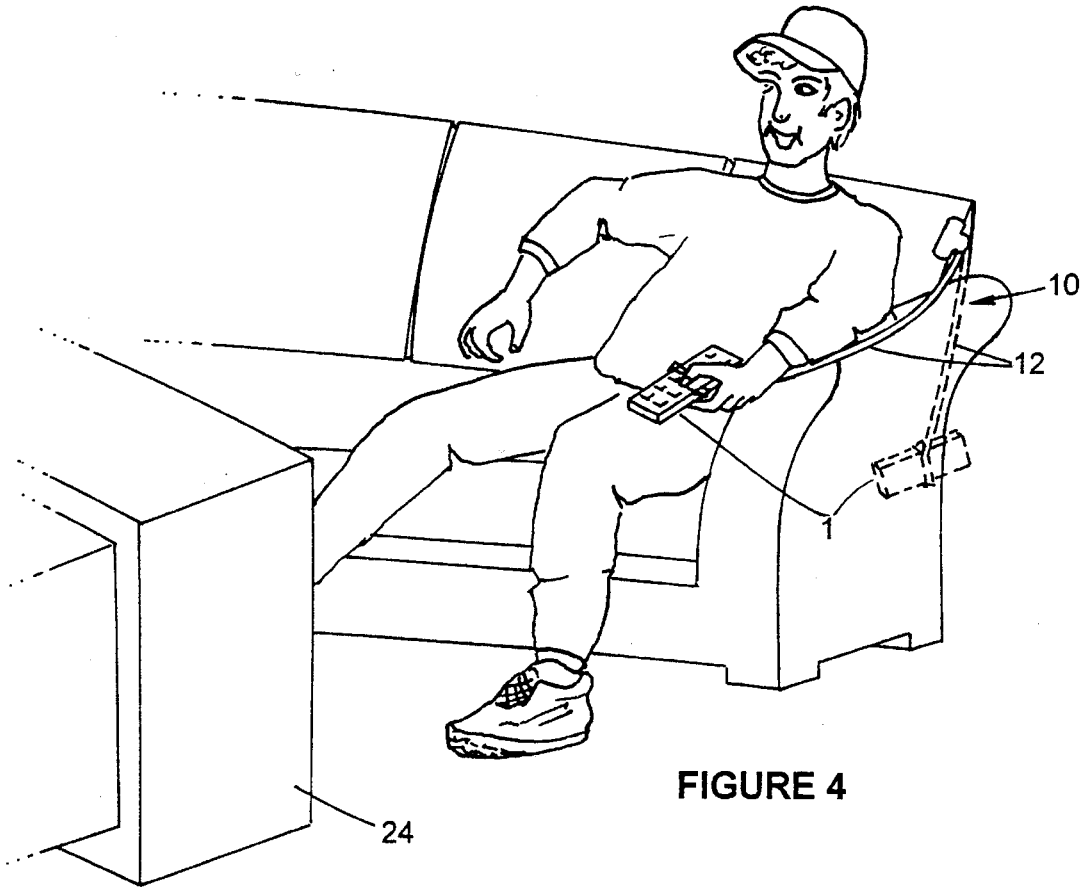
FIG. 4 depicts use of the remote control unit relative to operative association with a television set.

In exemplified use, the remote control unit 1, tethered with the device 10 of the present invention, is moved from its accessible position shown in FIG. 3, to an operative position as shown in FIG. 4, for remote operation of television set 24. After such operative use, the remote control unit 1 is automatically returned to its initial accessible tethered position for subsequent use as desired. Extension of the elastic strap 12 is shown whereby the remote control unit is never detached from the tethering device 10, whereby the remote control unit is not misplaced from its accessible use position.

It is understood that the specific description and depiction of the tethering device of the present invention is illustrative in nature and that various means for removable position anchoring and attachment to remote control units is possible as well as variations in the structure, configuration and composition of the connection therebetween, without departing from the scope of the present invention as defined in the following claims.

What is claimed is:

1. A tethering device in combination with a stand-alone, hand held remote control unit having controls thereon for operation of an electronic device, said tethering device comprising adjustable attachment means capable of being removably attached to a plurality of objects in operative proximity to the electronic device, the tethering device further comprising elastic adjustable holding means capable of snugly holding remote control units of varying dimensions with a non-slip grip, without impeding use of the controls thereon, wherein said elastic adjustable holding means comprises strap means which snugly fits around the remote control unit, with stretching thereof, without impeding operation of the controls thereof, and wherein the straps means are infinitely adjustable to effect the snug fit, and wherein the device further comprises removable locking means to maintain the snug fit, wherein the adjustable attachment means and adjustable holding means are connected by connection means, whereby remote control units are held by the tethering device in a position accessible to a user and wherein said connecting means is adapted to permit movement of the remote control unit, by a user's hand, into operative association with the electronic device.

2. The tethering device of claim 1, wherein the adjustable attachment means comprises a spring loaded clip.

3. The tethering device of claim 2, wherein the spring loaded clip is comprised of engaging jaw elements and wherein the engaging portions of the jaw elements have marring protection means thereon.

4. The tethering device of claim 1, wherein the locking means comprises a tightening ring.

5. The tethering device of claim 1, wherein the locking means comprises areas on said strap means of separate engageable hooks and eyes, separated and dimensioned to provide a holding loop which provides the snug fit when engaged with each other.

6. The tethering device of claim 1, wherein the connecting means comprises an elastic band.

7. The tethering device of claim 6, wherein the strap means comprises an end portion of the elastic band.

8. A tethering device in combination with a stand-alone, hand held remote control unit having controls thereon for operation of an electronic device, said tethering device comprising adjustable attachment means comprising a spring loaded clip with engaging jaw elements having marring protection means thereon, said attachment means being capable of being removably attached to a plurality of objects in operative proximity to the electronic device, the tethering device further comprising elastic adjustable holding means capable of snugly holding remote control units of varying dimensions with a non-slip grip, without impeding use of the controls thereon, wherein said elastic adjustable holding means comprises strap means which snugly fits around the remote control units, with stretching thereof, without impeding operation of the controls thereof, and wherein the straps means are infinitely adjustable to effect the snug fit, and wherein the device further comprises removable locking means to maintain the snug fit, wherein the adjustable attachment means and adjustable holding means are connected by elastic connection means, whereby remote control units are held by the tethering device in a position accessible to a user and wherein said connecting means is adapted to permit movement of the remote control unit, by a user's hand, into operative association with the electronic device.

* * * * *